US006768879B2

(12) United States Patent
Kosuge

(10) Patent No.: US 6,768,879 B2
(45) Date of Patent: Jul. 27, 2004

(54) IMAGE FORMING APPARATUS THAT APPLIES LUBRICANT TO A SURFACE OF IMAGE CARRIER

(75) Inventor: Akio Kosuge, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/316,156

(22) Filed: Dec. 11, 2002

(65) Prior Publication Data

US 2004/0047642 A1 Mar. 11, 2004

(30) Foreign Application Priority Data

Dec. 11, 2001 (JP) ..... 2001-377801
Dec. 2, 2002 (JP) ..... 2002-349663

(51) Int. Cl.[7] ..... G03G 15/08
(52) U.S. Cl. ..... 399/53; 399/296
(58) Field of Search ..... 399/38, 49, 60, 399/67, 71, 105, 114, 159, 252, 296, 343; 430/67, 105, 114

(56) References Cited

U.S. PATENT DOCUMENTS 6,122,468 A 9/2000 Sakamoto et al.
6,136,491 A * 10/2000 Yamauchi ..... 430/111
6,249,304 B1 6/2001 Sawayama et al.

FOREIGN PATENT DOCUMENTS

JP 1-170951 7/1989
JP 01-170951 * 7/1989
JP 2-44388 2/1990
JP 3-7977 1/1991
JP 03/050562 3/1991
JP 4-5679 1/1992
JP 05-040438 2/1993
JP 7-152299 6/1995
JP 7-281490 10/1995
JP 08-234642 * 9/1996
JP 9-127843 5/1997
JP 10-177330 6/1998
JP 10-186989 7/1998
JP 2000-19920 1/2000
JP 2000-112298 4/2000
JP 2000-162881 6/2000
JP 2000-356871 12/2000
JP 2001-42740 2/2001
JP 2002-229241 8/2002

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes an image carrier that rotates and carries an image on a surface of the image carrier, a latent image forming device that forms an electrostatic latent image on the image carrier, a developing device that develops the electrostatic latent image with a developer including a lubricant, and a transfer device that transfers the developed image to a transfer material. The image forming apparatus further includes a control device including a lubricant application executing device and controlling the lubricant application executing device to execute an application of the lubricant to the image carrier by actuating the developing device to apply the developer to the surface of the image carrier during one job of an image forming operation from a start of rotation of the image carrier to a stopping of the rotation of the image carrier.

21 Claims, 9 Drawing Sheets

| FIG. 2A |
|---|
| FIG. 2B |

FIG. 7

| IMAGE AREA RATIO [%] | 2.5 OR GREATER | 1.0~2.5 | 0.5~1.0 | 0~0.5 |
|---|---|---|---|---|
| ON-TIME OF DEVELOPING CLUTCH [ms] | 0 | 50 | 100 | 150 |
| DEVELOPING BIAS [V] | 0 | −70 | −120 | −170 |

IMAGE FORMING APPARATUS THAT APPLIES LUBRICANT TO A SURFACE OF IMAGE CARRIER

CROSS-REFERENCE TO RELATED APPLICATIONS

The present application claims priority to Japanese Patent Application No. 2001-377801 filed in the Japanese Patent Office on Dec. 11, 2001 and Japanese Patent Application No. 2002-349,663 filed in the Japanese Patent Office on Dec. 2, 2002, the disclosures of which are hereby incorporated by reference herein in their entirety.

BACKGROUND OF THE INVENTION

1. Field of the Invention

The present invention relates to an electrophotographic image forming apparatus such as a copying machine, a facsimile machine, a printer, or other similar image forming apparatus, and more particularly relates to an image forming apparatus that forms images on transfer materials while repeating an electrophotographic image forming process including charging, image writing, developing, transferring, cleaning, and discharging steps.

2. Discussion of the Background

As an image carrier for use in an electrophotographic image forming apparatus, such as a copying machine, a facsimile machine, a printer, or other similar image forming apparatus, an organic photoreceptor made of organic photosensitive materials has been used because of its low cost, the ease of mass producing it, and because it is non-polluting. However, as compared to an inorganic photoreceptor, an organic photoreceptor has disadvantages, such as decreased durability and reduced abrasion resistance. Recently, a need has arisen for a photoreceptor having a small diameter because there is a demand for downsizing electrophotographic systems. A demand has also arisen for a photoreceptor having good durability against abrasion that increases in proportion to the number of copies. Thus, mechanical durability, which typically means abrasion resistance, is in strong demand.

Japanese Laid-open Patent Publication No. 1-170951 describes a method for improving the abrasion resistance of an organic photoreceptor whose surface includes a protective layer including a filler formed from a metal or a metal oxide. By this background method, a photoreceptor having a high mechanical durability can be obtained. However, in such an organic photoreceptor, the properties of the surface of the photoreceptor may be changed with time, because the surface of the photoreceptor is repeatedly charged with a charging device. As a result, toner from a toner image formed on the photoreceptor tends to adhere to the surface of the photoreceptor, and the transfer efficiency of the toner image formed on the photoreceptor can decrease, thereby causing an inferior image, such as a partial omission of a transferred image.

In order to prevent toner from adhering to the surface of the photoreceptor due to the surface property changes of the photoreceptor, a method has been employed in which surface energy of a photoreceptor is decreased by applying a lubricant onto the photoreceptor. As a background method of applying a lubricant onto a photoreceptor, Japanese Laid-open Patent Publication No. 2000-162881 describes a method of applying a lubricant onto a photoreceptor with a lubricant applying member, such as a brush. Further, Japanese Patent No. 2859646 and Japanese Laid-open Patent Publication No. 2002-229241 describe a method of applying a lubricant added to a toner onto a photoreceptor. By applying a lubricant onto a surface of a photoreceptor, the surface energy of the photoreceptor is decreased, thereby improving the mechanical durability of the photoreceptor and the transfer efficiency of a toner image, and preventing an occurrence of an inferior image, such as a partial omission of a transferred image.

With regard to the application of a lubricant onto a photoreceptor, some problems arise. When applying a lubricant onto a photoreceptor with a lubricant applying member, such as a brush, regular maintenance in terms of replacement of the lubricant is required. If a large quantity of lubricant is used to lengthen the maintenance interval, the size and cost of the apparatus increase.

On the other hand, when a lubricant is added to toner and applied onto a photoreceptor, fresh lubricant is applied to the photoreceptor by replacing a toner bottle. Therefore, as compared to the above-described case in which a lubricant is applied onto a photoreceptor with a lubricant applying member, maintenance of the lubricant itself and provision of the lubricant applying member are not required. However, there is a problem that the amount of the lubricant applied onto a photoreceptor depends on the area of the toner image formed on the photoreceptor. Specifically, when a large number of toner images are formed on the photoreceptor and toner for the toner images is transferred onto a transfer material, such as a transfer sheet, from the photoreceptor, a sufficient amount of lubricant added to the toner remains and is supplied onto the photoreceptor. However, when only a small number of toner images are formed on the photoreceptor, the amount of lubricant supplied onto the photoreceptor decreases accordingly.

SUMMARY OF THE INVENTION

According to an aspect of the present invention, an image forming apparatus includes an image carrier configured to rotate and carry an image on a surface of the image carrier, a latent image forming device configured to form an electrostatic latent image on the image carrier, a developing device configured to develop the electrostatic latent image with a developer including a lubricant, and a transfer device configured to transfer the developed image to a transfer material. The image forming apparatus further includes a control device including a lubricant application executing device and at least controlling the lubricant application executing device to execute an application of the lubricant to the image carrier by actuating the developing device to apply the developer to the surface of the image carrier during one job of an image forming operation from a start of rotation of the image carrier to a stopping of the rotation of the image carrier.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 7 is a table showing an example of lubricant application conditions according to the present invention.

DESCRIPTION OF THE PREFERRED EMBODIMENTS

Figure 1:
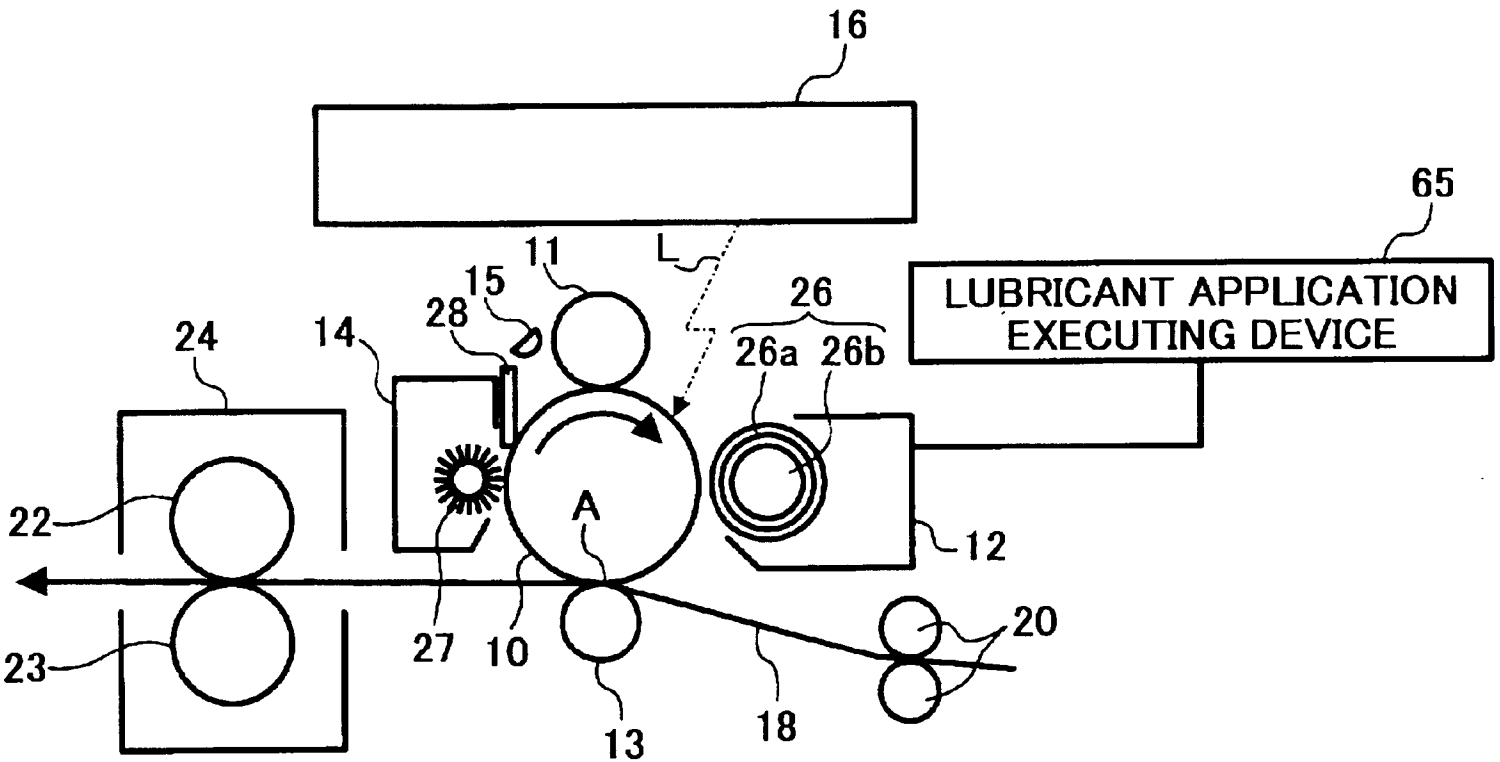
FIG. 1 is a schematic view of an image forming section in a laser printer as an example of an image forming apparatus according to one embodiment of the present invention.

Preferred embodiments of the present invention are described in detail with reference to the drawings, wherein like reference numerals designate identical or corresponding parts throughout the several views.

FIG. 1 is a schematic view of an image forming section in a laser printer as an example of an image forming apparatus according to one embodiment of the present invention. The laser printer of FIG. 1 includes a drum-shaped image carrier 10 that rotates in a clockwise direction as indicated by an arrow on the image carrier 10 in FIG. 1. Arranged around the image carrier 10 in the direction of rotation in the following order are a charging device 11, a developing device 12, a transfer device 13, a cleaning device 14, a discharging device 15, etc. The laser printer further includes an image writing device 16 as a latent image forming device positioned above the charging device 11.

The laser printer further includes a transfer material conveying path 18 below the image carrier 10. In the transfer material conveying path 18, a transfer material, such as a transfer sheet, and an overhead transparency film, passes a transfer position (A) formed between the image carrier 10 and the transfer device 13 and is conveyed from the right to the left-hand side as viewed in FIG. 1. A pair of registration rollers 20 are provided on the transfer material conveying path 18.

The laser printer further includes a fixing device 24 having a heat roller 22 and a pressure roller 23 at the downstream side of the transfer position (A) in a transfer material conveying direction. Although not shown, the laser printer of FIG. 1 further includes a pair of transfer material discharging rollers and a transfer material discharging tray at the downstream side of the fixing device 24 in the transfer material conveying direction, and other features of a laser printer known by one of ordinary skill in the art.

Figures 2, 2A:
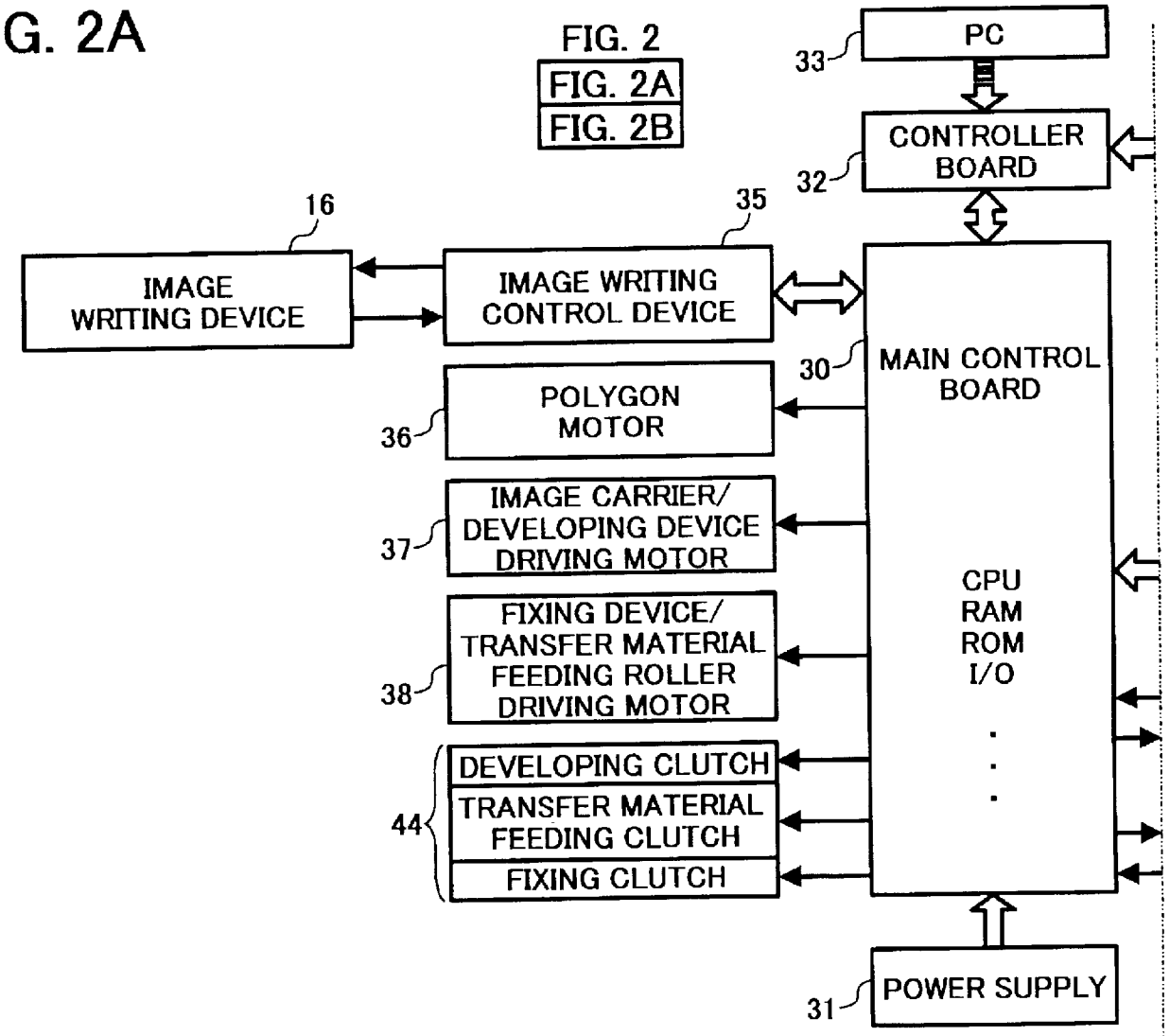
FIG. 2 shows the relationship between FIG. 2A and FIG. 2B that together form a block diagram for explaining a control operation of a control device in the laser printer of FIG. 1.

Referring to FIG. 2A, the laser printer includes a main control board 30 as a control device. The main control board 30 includes a central processing unit (CPU), a non-volatile random-access memory (RAM), a read-only memory (ROM), and input/output interfaces I/O, etc. Electric power is supplied to the main control board 30 from a power supply 31. The main control board 30 is connected to a personal computer (PC) 33 via a controller board 32 through a network (not shown). The controller board 32 is connected to an operation/display panel 34 shown in FIG. 2B.

The main control board 30 is connected to an image writing control device 35 that controls the image writing device 16 to write an electrostatic latent image on the surface of the image carrier 10. Further, the main control board 30 controls a polygon motor 36 in the image writing device 16, and controls an image carrier/developing device driving motor 37 to drive the image carrier 10 and the developing device 12. Moreover, the main control board 30 controls a fixing device/transfer material feeding roller driving motor 38 to drive the fixing device 24 and transfer material feeding rollers, and controls developing/transfer material feeding/fixing clutches 44 to be engaged and disengaged.

Figure 2B:
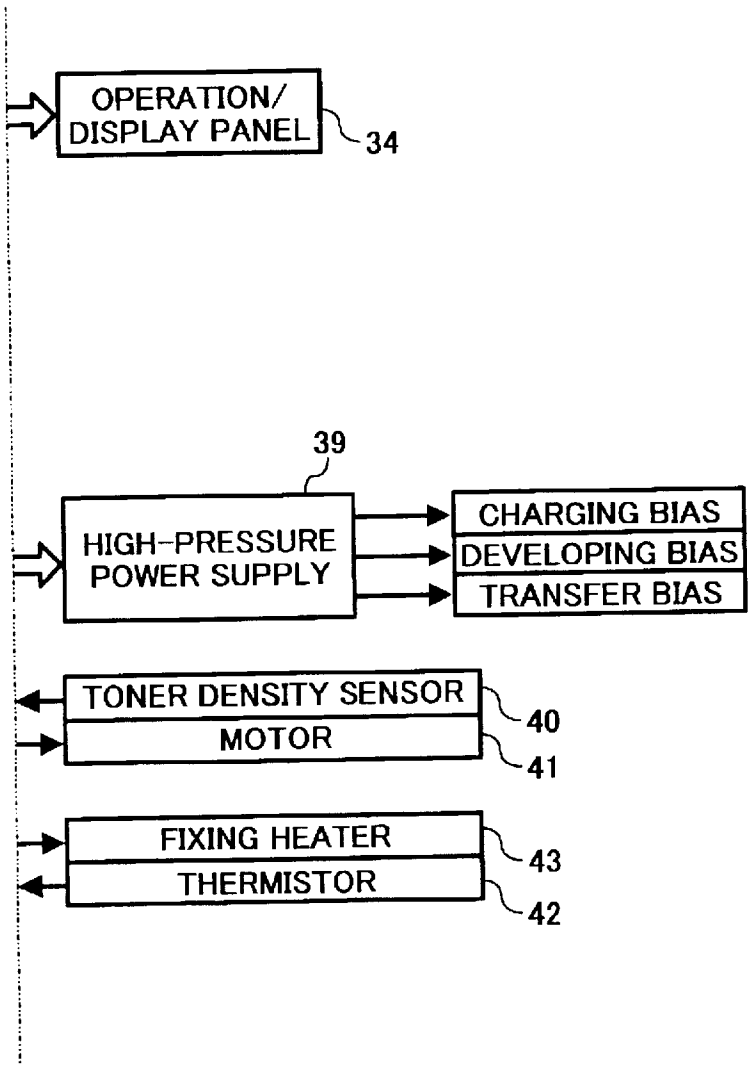

In addition, as shown in FIG. 2B, the main control board 30 controls a high-pressure power supply 39 to apply various kinds of bias voltages, such as a charging bias, a developing bias, or a transfer bias, etc., to the devices in the laser printer. Further, the main control board 30 controls a motor 41 to drive a toner replenishing device (not shown) based on an output signal from a toner density sensor 40 in the developing device 12. Moreover, the main control board 30 controls a fixing heater 43 in the heating roller 22 to turn on and off based on an output signal from a thermistor 42 in the fixing device 24.

When forming an image on a transfer material in the above-described laser printer, the image carrier 10 is rotated by driving the image carrier/developing device driving motor 37 based on signals sent from the personal computer 33. With rotation of the image carrier 10, the surface of the image carrier 10 is uniformly charged by the charging device 11 to which a charging bias is applied from the high-pressure power supply 39. Subsequently, the image writing control device 35 controls the image writing device 16 to irradiate the charged surface of the image carrier 10 with an image writing light (L), as shown in FIG. 1, and thereby an electrostatic latent image is formed on the image carrier 10.

At substantially the same time of driving the image carrier 10, a developing roller 26 in the developing device 12 is driven to rotate by the image carrier/developing device driving motor 37. The developing bias is applied from the high-pressure power supply 39 to the developing roller 26, and thereby the developing roller 26 develops the electrostatic latent image formed on the image carrier 10 with a developer including a mixture of toner and carrier. As a result, a toner image is formed on the image carrier 10.

While the image carrier 10 rotates, the main control board 30 controls the fixing device/transfer material feeding device driving motor 38 to feed a transfer material out from a transfer material feeding cassette (not shown) and convey it along the transfer material conveying path 18 to the pair of registration rollers 20. The pair of registration rollers 20 rotate to feed the transfer material with a timing such that a leading edge of the toner image on the image carrier 10 is aligned with a leading edge of the transfer material, and convey the transfer material along the transfer material conveying path 18 toward the transfer position (A). The toner image on the image carrier 10 is transferred to the transfer material at the transfer position (A) while the transfer bias from the high-pressure power supply 39 is applied to the transfer device 13.

The transfer material having a transferred toner image is then conveyed along the transfer material conveying path 18 to the fixing device 24. The toner image is fixed onto the transfer material by heat and pressure of the heating roller 22 and the pressure roller 23 in the fixing device 24. The transfer material having a fixed toner image is fed from the laser printer by the transfer material expelling rollers (not shown) and is stacked on the expelled transfer material tray (not shown).

The residual toner remaining on the image carrier 10 after the toner image is transferred to the transfer material is removed by a cleaning brush 27 and a cleaning blade 28 in the cleaning device 14. The surface of the image carrier 10 having passed the cleaning blade 28 is discharged by the discharging device 15 in preparation for a next image forming operation.

Figure 3:
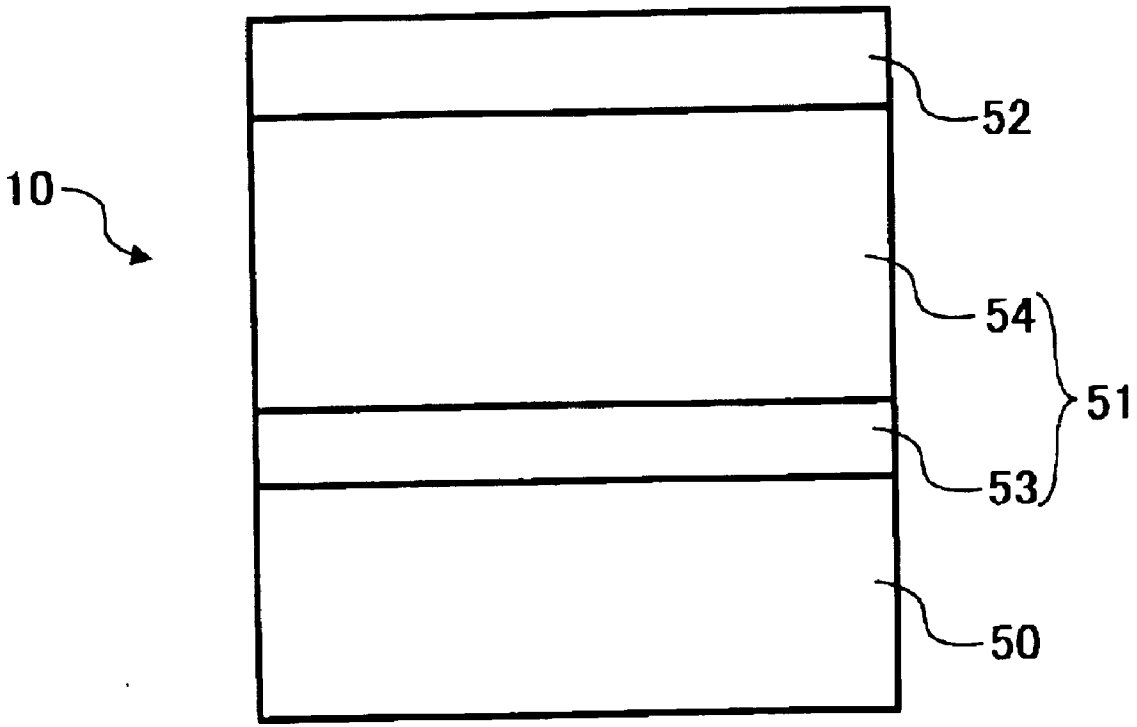
FIG. 3 is a schematic cross-sectional view of a multilayer electrophotographic image carrier according to the embodiment of the present invention.

Hereinafter, the details of the image carrier 10 used in the laser printer according to the present embodiment will be described. FIG. 3 is a schematic cross-sectional view of a multilayer electrophotographic image carrier according to the present embodiment. The image carrier 10 includes an electroconductive substrate 50, a photosensitive layer 51 including a charge generation layer 53 formed from a charge generation material and a charge transport layer 54 formed from a charge transport material, and a protective layer 52 formed as a surface layer. The photosensitive layer 51 is located overlying the electroconductive substrate 50.

The electroconductive substrate 50 is made of a material having a conductivity, such that its volume resistivity is $10^{10}$ ohm-cm or less, for example, tube-shaped metals, such as aluminium and stainless steel, and endless-belt shaped metals, such as nickel.

The charge generation layer 53 is formed from a charge generation material. Examples of the charge generation materials include monoazo pigments, disazo pigments, trisazo pigments, and phthalocyanine pigments. The charge generation layer 53 is formed by dispersing the charge generation material and a binder resin, such as polycarbonate resins, in a solvent such as tetrahydrofuran and cyclohexanone, and applying the dispersion liquid obtained on substrate 50. Application of the dispersion liquid is performed by dip-coating, spray-coating, etc. The thickness of the charge generation layer 53 is typically from approximately 0.01 $\mu$m to approximately 5 $\mu$m, and preferably from approximately 0.1 $\mu$m to approximately 2 $\mu$m.

The charge transport layer 54 is formed by dissolving or dispersing a charge transport material and a binder resin in an appropriate solvent such as tetrahydrofuran, toluene, and dichlorethane, and by applying and drying the liquid obtained. If required, a plasticizer, a leveling agent, or the like may be also added.

In the charge transport materials, low-molecular-weight charge transport materials are grouped into electron transport materials and hole transport materials. Examples of the electron transport materials include electron-accepting substances such as chloranil, bromanil, tetracyanoethylene, tetracyanoquinodimethane, 2,4,7-trinitro-9-fluorenone, 2,4,5,7-tetranitro-9-fluorenone, 1,3,7-trinitrodibenzothiophen-5,5-dioxide, and the like.

Examples of the hole transport materials include electron-releasing substances such as oxazole derivatives, oxadiazole derivatives, imidazole derivatives, triphenylamine derivatives, phenylhydrazone, α-phenylstilbene derivatives, thiazole derivatives, triazole derivatives, phenazine derivatives, acridine derivatives, and thiophene derivatives.

Specific examples of the binder resins for use in the charge transport layer 54 together with the charge transport material include thermoplastic or thermosetting resins, such as polystyrene resins, styrene-acrylonitrile copolymers, styrene-butadiene copolymers, polyester resins, polyarylate resins, polycarbonate resins, acrylic resins, epoxy resins, melamine resins, and phenol resins. The thickness of the charge transport layer 54 may be selected from a range of approximately 5 $\mu$m to approximately 30 $\mu$m according to the required properties of the image carrier 10.

In the multilayer electrophotographic image carrier 10, an undercoat layer can be formed between the electroconductive substrate 50 and the photosensitive layer 51. The undercoat layer typically includes a resin as a main component. Considering that the photosensitive layer 51 is coated on the undercoat layer with a solvent, the resin preferably has good resistance against a general organic solvent. Specific examples of such resins include water-soluble resins, such as polyvinyl alcohol resins; alcohol-soluble resins, such as nylon copolymers; and thermosetting resins forming a three-dimensional network, such as polyurethane resins, alkyd-melamine resins, and epoxy resins.

The undercoat layer can include a fine powder of metal oxides such as titanium oxides, silica, and alumina to prevent occurrence of moiré in the resultant images and to decrease the residual potential of the resultant image carrier. Similarly, as in the photosensitive layer 51, the undercoat layer can be formed using a suitable solvent and a suitable coating method. The thickness of the undercoat layer is preferably from approximately 0 $\mu$m to approximately 5 $\mu$m.

The protective layer 52 including a filler is formed on the image carrier 10 as a surface layer to protect the photosensitive layer 51 and to improve the durability. Examples of fillers added to the protective layer 52 include fine powders of metal oxides such as titanium oxides, silica, and alumina.

It is preferable that an average particle diameter of the filler is from approximately 0.1 $\mu$m to approximately 0.8 $\mu$m. If the average particle diameter of the filler is too large, the image writing light (L) is scattered by the protective layer 52, thereby lowering resolving power, resulting in a deterioration of image quality. If the average particle diameter of the filler is too small, the abrasion resistance decreases.

The amount of the filler added to the protective layer 52 is preferably from approximately 10% to approximately 40% by weight, and more preferably from approximately 20% to approximately 30% by weight. If the amount of the filler is less than approximately 10% by weight, the abrasion increases and the durability decreases. If the amount is greater than approximately 40% by weight, the sensitivity significantly decreases and the residual potential of the image carrier increases.

The protective layer 52 is formed by dispersing the filler and a binder resin in an appropriate solvent, and applying the dispersion liquid obtained onto the photosensitive layer 51 by a spray coating method. As binder resins and solvents for use in the protective layer 52, materials similar to those used in the charge transport layer 54 can be used. The thickness of the protective layer 52 is preferably from approximately 3 $\mu$m to approximately 10 $\mu$m. A charge transport material and an antioxidant can be added to the protective layer 52.

In the present embodiment, an organic photoreceptor whose surface portion includes the protective layer 52 containing a filler is used as the image carrier 10. However, other types of photoreceptors may be used as the image carrier 10. Further, in the present embodiment, the image carrier 10 has a drum shape. Alternatively, the image carrier 10 can have a belt shape.

In the laser printer of FIG. 1, a charging bias is applied from the high-pressure power supply 39 to the charging device 11. The charging bias includes a direct current component or a direct current component superimposed with an alternating current component. In the present embodiment, a charging roller is used as the charging device 11. In place of the charging roller, the charging device can be a contact type charging device, such as a brush, or a non-contact type charging device, such as a charger.

Further, in the laser printer of FIG. 1, the developing device 12 includes the developing roller 26 facing the image carrier 10, a developer conveying screw (not shown), and the toner density sensor 40 (shown in FIG. 2B). As shown in FIG. 1, developing roller 26 includes a rotatable developing sleeve 26*a* having a tube shape, and a magnet 26*b* fixed inside of the developing roller 26.

The developer used in the developing device 12 is a two-component developer including a mixture of toner and carrier. The carrier in the two-component developer includes magnetic particles having a particle diameter of about 50 $\mu$m such as ferrite, magnetite, and iron. The surface of the magnetic particles is covered with resins, such as silicone resins, by a spray coating method. The toner in the two-component developer includes particles of binder resins such as ester resins, acrylic resins, and styrene resins; pigment; charge controlling agent, which are mixed, ground, and classified. In addition, external additives, such as silica and titania, are added to the classified particles. The particle diameter of the toner is about 7 $\mu$m. The toner can be prepared by a polymerization method, such as a suspension polymerization method, and an emulsion polymerization method. The shape of toner particles may be spherical, elliptic, or irregular.

The developer used in the laser printer according to the present embodiment includes a lubricant. Examples of the lubricant include a metallic soap of zinc stearate, for example, and a powder of fluororesin, for example. The lubricant is added to the toner in the developer. The particle diameter of the lubricant added to the toner is preferably from approximately 0.5 $\mu$m to approximately 5 $\mu$m. The amount of the lubricant added to the toner is preferably from approximately 0.01% to approximately 0.5% by weight.

The lubricant is adhered to the surface of the image carrier 10 together with the toner and is spread out on the surface of the image carrier 10 by the cleaning blade 28. The lubricant thereby decreases the surface energy of the image carrier 10, and prevents the occurrence of filming due to paper powder and toner, and prevents the occurrence of inferior images, such as resulting from a partial omission of a transferred image.

Other than adding powders of lubricant to toner, a developer can contain a lubricant by dispersing wax, such as carnauba wax and oil, such as silicone oil therein. Such wax and oil are mixed and ground with the particles of binder resins, pigment, and charge controlling agent, and are thereby dispersed in the toner.

In the laser printer of FIG. 1, a transfer roller is used as the transfer device 13. In place of the transfer roller, the transfer device can be a contact type transfer device, such as a brush or a belt, and can be a non-contact type transfer device, such as a charger.

The discharging device 15 uses a discharging lamp to discharge the surface of the image carrier 10 with light.

The image writing device 16 can use a laser diode (LD) or a light-emitting diode (LED), etc.

Figure 4:
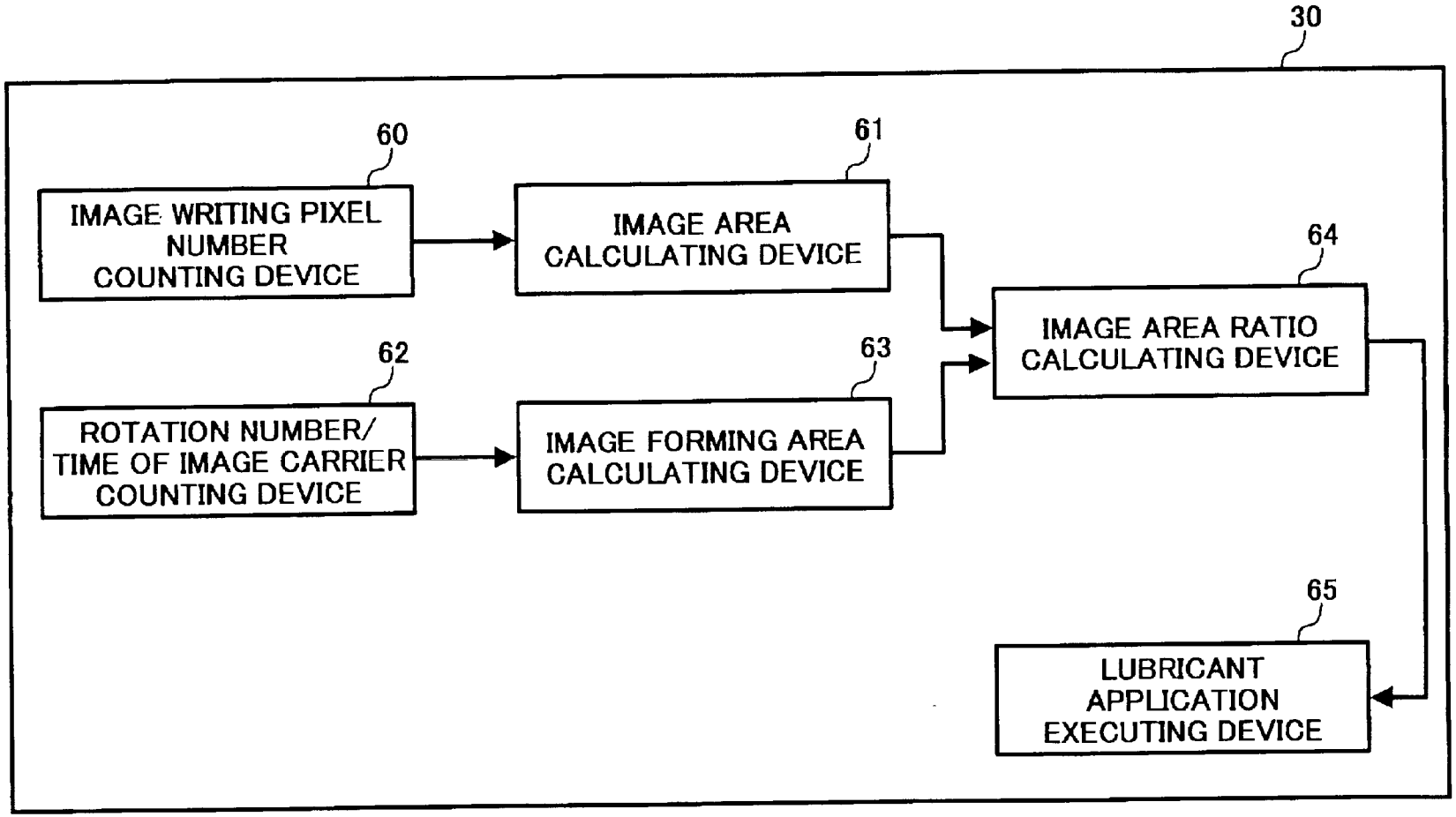
FIG. 4 is a block diagram for explaining a lubricant application control operation of a main control board of the laser printer of FIG. 1.

FIG. 4 is a block diagram for explaining a lubricant application control operation of the main control board 30. Referring to FIG. 4, the main control board 30 includes an image writing pixel number counting device 60 that counts the number of image writing pixels, and an image area calculating device 61 that calculates the area of an image formed on the surface of the image carrier 10 based on the number of image writing pixels counted by the image writing pixel number counting device 60.

The area of an electrostatic latent image on the image carrier 10 to be developed with toner by the developing device 12 is obtained by the following calculation:

$$A \times B,$$

in which (A) is the number of image writing pixels and (B) is the area of one image writing pixel. Because the area of one image writing pixel is predetermined, an image area is obtained by counting a number of image writing pixels by the image writing pixel number counting device 60.

Referring again to FIG. 4, the main control board 30 further includes a rotation number/time of image carrier counting device 62 that counts a number or time of rotations of the image carrier 10, and an image forming area calculating device 63 that calculates an image forming area of the image carrier 10 based on the number or time of rotations of the image carrier 10 counted by the rotation number/time of image carrier counting device 62.

Specifically, the image forming area of the image carrier 10 is obtained by the following calculation:

$$C \times D,$$

in which (C) is the running distance of the image carrier 10, and (D) is the image forming width of the image carrier 10 in an axial direction of the image carrier 10. Because the image forming width of the image carrier 10 is predetermined, the image forming area of the image carrier 10 is obtained by calculating the running distance of the image carrier 10.

The running distance of the image carrier 10 is obtained by the following calculation:

$$E \times F,$$

in which (E) is the number of rotations of the image carrier 10, and (F) is the peripheral length of the image carrier 10.

Alternatively, the running distance of the image carrier 10 is obtained by the following calculation:

$$G \times H,$$

in which (G) is the time of rotations of the image carrier 10, and (H) is the linear velocity of the image carrier 10. In the above calculations, because the peripheral length and linear velocity of the image carrier 10 are predetermined, the running distance of the image carrier 10 is obtained by counting the number or time of rotations of the image carrier 10 by the rotation number/time of image carrier counting device 62.

The respective calculation results of the image area calculating device 61 and the image forming area calculating device 63 are input to an image area ratio calculating device 64 that calculates a ratio of the image area to the image forming area of the image carrier 10. The ratio is obtained by the following calculation:

$$I/J,$$

in which (I) is the image area calculated by the image area calculating device 61, and (J) is the image forming area of the image carrier 10 calculated by the image forming area calculating device 63.

Based on the ratio of the image area to the image forming area of the image carrier 10 calculated by the image area ratio calculating device 64, the main control board 30 controls a lubricant application executing device 65 (of FIGS. 1 and 4) to execute an application of the lubricant to the image carrier 10 by actuating the developing device 12 to apply the developer including the lubricant to the surface of the image carrier 10.

Figure 5:
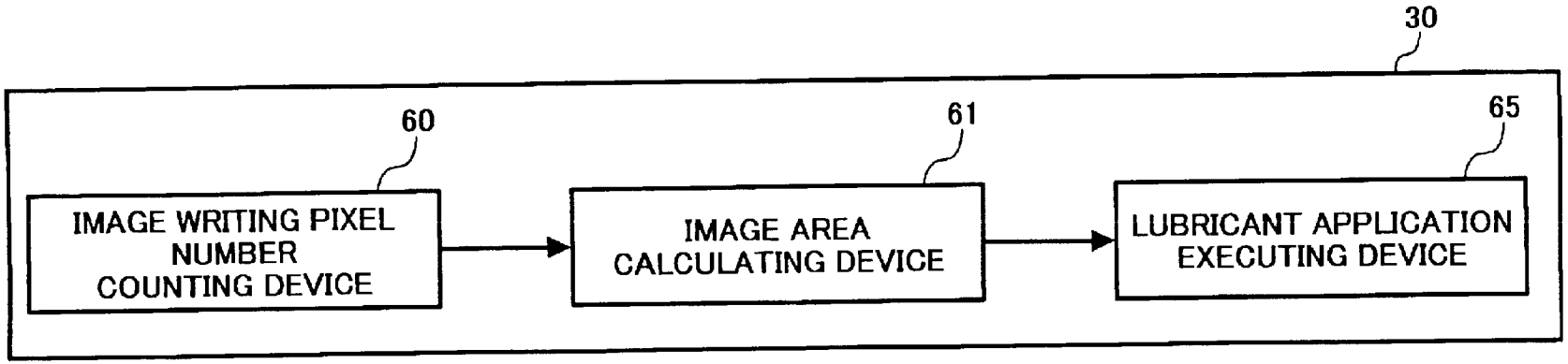
FIG. 5 is a block diagram for explaining a lubricant application control operation of the main control board according to an alternative example.

FIG. 5 is a block diagram for explaining a lubricant application control operation of the main control board 30 according to an alternative example. As an alternative lubricant application control operation of the main control board 30, the main control board 30 can control the lubricant application executing device 65 to execute an application of the lubricant to the image carrier 10 based on the image area calculated by the image area calculating device 61.

Figure 6:
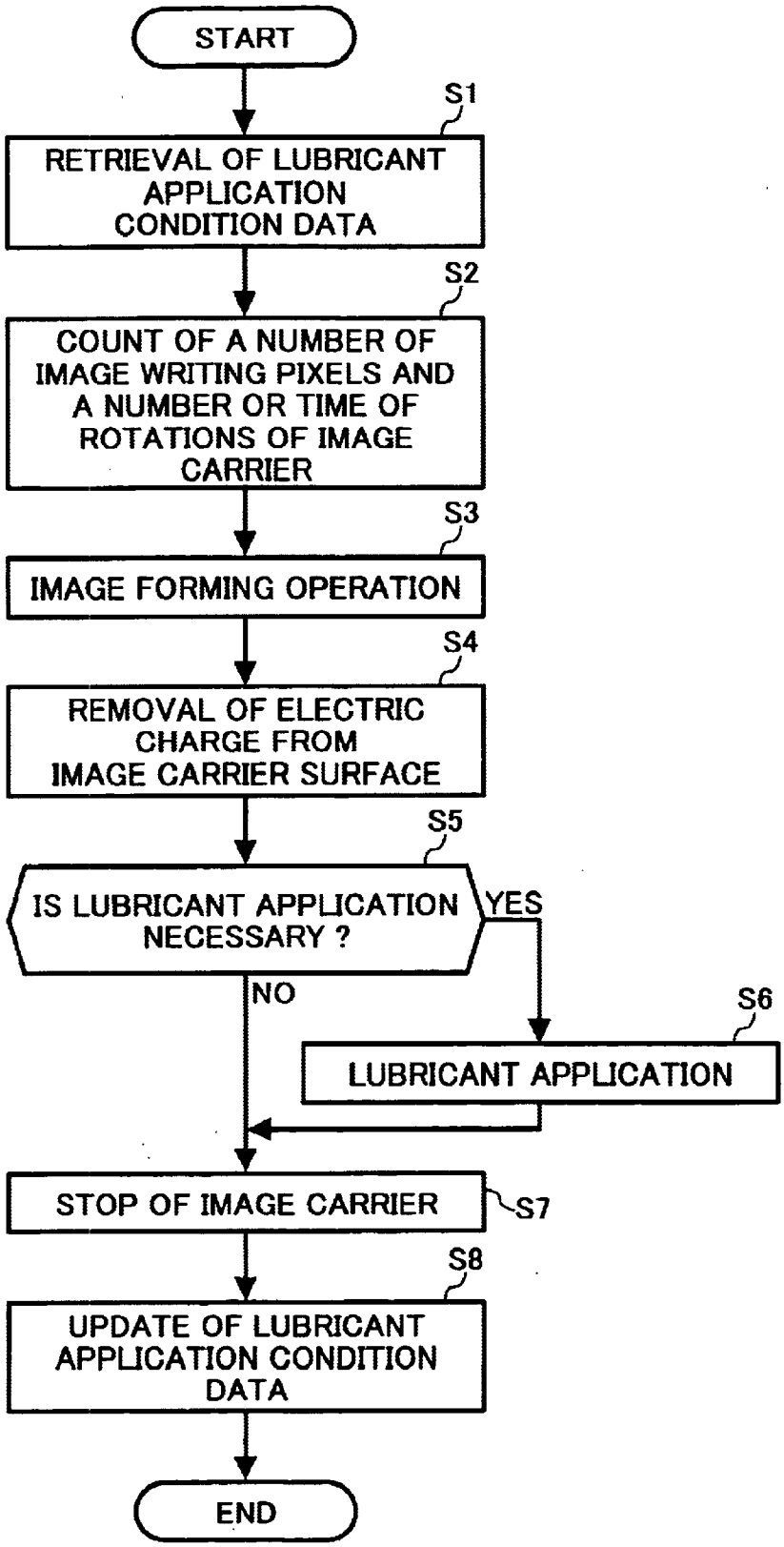
FIG. 6 is a flowchart illustrating the main steps of a lubricant application control operation of the laser printer according to the present invention.

FIG. 6 is a flowchart illustrating the main steps of a lubricant application control operation of the laser printer according to one embodiment of the present invention. In step S1, after the controller board 32 receives image data from the personal computer 33 connected to the controller board 32 through the network, the CPU of the main control board 30 retrieves data of lubricant application conditions stored in the non-volatile RAM in the main control board 30. The lubricant application conditions will be described in more detail below. In step S2, the image writing pixel number counting device 60 starts counting the number of image writing pixels, and the rotation number/time of image carrier counting device 62 starts counting the number or time of rotations of the image carrier 10.

Subsequently, in step S3, an image forming operation is performed. Specifically, in the image forming operation, the image carrier 10 is driven to rotate first, and toner images are formed on the image carrier 10 while repeating an electrophotographic image forming process including charging, image writing, developing, transferring, cleaning, and discharging steps. The toner images formed on the image carrier 10 are sequentially transferred to transfer materials.

During one job of an image forming operation from the start of rotation of the image carrier 10 to the stopping of the image carrier 10, after a toner image formed for a last transfer material is transferred from the image carrier 10 to the last transfer material, the discharging device 15 starts discharging the surface of the image carrier 10 in the step S4. An electric charge on the surface of the image carrier 10 is removed to prevent electrostatic fatigue. In the illustrative image forming operation, the surface of the image carrier 10 can be discharged by the discharging device 15 with light. In place of the discharging device 15, the surface of the image carrier 10 is discharged by the charging device 11 while applying an AC bias to the charging device 11. Alternatively, a discharging operation using both light and AC bias can be performed.

Next, the main control board 30 judges if a lubricant application is necessary or not based on the data of lubricant application conditions retrieved in step S1. If the answer is YES in step S5, the main control board 30 controls the lubricant application executing device 65 to execute an application of the lubricant to the image carrier 10 by actuating the developing device 12 to apply a developer including a lubricant to the discharged surface of the image carrier 10 during the discharging operation of the discharging device 15 in step S6.

Subsequently, the main control board 30 controls the image carrier/developing device driving motor 37 to stop driving the image carrier 10, and thereby the image carrier 10 stops rotating in step S7. In the lubricant application control operation in FIG. 6, the period of steps through S3 to S7 corresponds to one job of an image forming operation from the start of rotation of the image carrier 10 to the stopping of the image carrier 10. In the above-described lubricant application control operation, the lubricant application executing device 65 executes the application of the lubricant to the image carrier 10 in a period in one job after an electrostatic latent image formed for a last transfer material is developed by the developing device 12 and before the stopping of the image carrier 10. If the answer is NO in step S5, the lubricant application control operation proceeds to step S7, and the image carrier 10 stops rotating.

After the image carrier 10 stops rotating in step S7, the image writing pixel number counting device 60 counts the number of image writing pixels, and the image area calculating device 61 calculates the image area based on the number of image writing pixels counted by the image writing pixel number counting device 60. On the other hand, the rotation number/time of image carrier counting device 62 counts a number or time of rotations of the image carrier 10, and the image forming area calculating device 63 calculates the image forming area of the image carrier 10 based on the counted number or time of rotations of the image carrier 10.

Subsequently, the image area ratio calculating device 64 calculates the ratio of the image area calculated by the image area calculating device 61 to the image forming area of the image carrier 10 calculated by the image forming area calculating device 63. Based on the calculation result of the image area ratio calculating device 64, new lubricant application conditions are determined. In step S8, the new lubricant application conditions are stored in the non-volatile RAM in the main control board 30 to update the data of lubricant application conditions. In addition, the values counted by the image writing pixel number counting device 60 and the rotation number/time of image carrier counting device 62 are cleared.

After the completion of a succeeding job of image forming operation, the lubricant application executing device 65 executes the application of the lubricant to the image carrier 10 based on the updated lubricant application conditions. As described above, the lubricant application conditions are controlled to be determined based on the calculation results obtained in the preceding job. Thus, the lubricant application conditions are determined while counting a number or time of rotations of the image carrier 10 and a number of image writing pixels in real time during the job. As a result, the load on the CPU in the main control board 30 is greatly reduced and the program can be simplified.

In a background image forming apparatus, a developing device is driven only during a developing operation, and the rotation of a developing sleeve is stopped during a discharging operation. Thus, deterioration of developer is reduced, and unnecessary consumption of toner is prevented by turning off a developing bias. In the illustrative lubricant application control operation, the developing device 12 is driven, the developing sleeve 26*a* is rotated, and the developing bias is turned on during the discharging operation in addition to the developing operation. As described above, the image carrier 10 and the developing device 12 are driven by the image carrier/developing device driving motor 37. The developing sleeve 26*a* in the developing device 12 is rotated by engaging the developing clutch 44 (shown in FIG. 2A). By applying a developing bias to the developing roller 26 from the high-pressure power supply 39, the developer is adhered to the surface of the image carrier 10, that is, the lubricant is applied to the surface of the image carrier 10.

In the above-described lubricant application control operation, the lubricant is controlled to be applied to the image carrier 10 during the discharging operation performed by the discharging device 15. Therefore, a separate operation time for only applying the lubricant is not required during the image forming operation, so that the lubricant application can be performed efficiently.

In order for the lubricant to fully exert its effect and to reduce to a minimum the amount of toner consumption, it is preferable that the amount of lubricant (i.e., the amount of toner) to be applied to the surface of the image carrier 10 should be changed according to the ratio of the image area.

In the illustrative lubricant application control operation, the lubricant application executing device 65 adjusts the amount of lubricant to be applied to the image carrier 10 judging from the image area ratio calculated by the image area ratio calculating device 64. There are two methods of adjusting the amount of lubricant to be applied to the image carrier 10: (1) the method of changing the area of the surface of the image carrier 10 to be developed with the developer while adjusting the ON-time of the developing clutch 44 for rotating the developing sleeve 26*a* during a lubricant applying operation, and (2) the method of changing the adhesion amount of toner per unit area while adjusting the value of developing bias to be applied to the developing roller 26 during a lubricant applying operation. The combination of the above two methods can also be used.

FIG. 7 is a table showing an example of lubricant application conditions according to the present embodiment. As illustrated in FIG. 7, the ON-time of the developing clutch 44 and the value of developing bias during the lubricant applying operation are set according to the ratio of image area calculated by the image area ratio calculating device 64. In the present embodiment, the surface potential of the image carrier 10 during the discharging operation is −20V.

In this FIG. 7 example, four-level lubricant application conditions are set by changing the both values of the ON-time of the developing clutch 44 and the developing bias. Alternatively, the lubricant application conditions can be set by changing one of the values of the ON-time of the developing clutch 44 and the developing bias. Further, the lubricant application conditions may have less levels for the sake of simplification.

The lubricant applied to the image carrier 10 of FIG. 1 is spread out on the surface of the image carrier 10 by the cleaning blade 28 in the cleaning device 14. Therefore, in an image forming apparatus using the contact-type transfer device 13, it is preferable that the transfer device 13 is separated from the image carrier 10 or a bias voltage having a polarity opposite to that of the transfer bias is applied to the transfer device 13 during the lubricant applying operation. Thus, the toner is prevented from adhering to the transfer device 13, and thereby the lubricant application efficiency can be increased.

If the image area ratio is obtained by calculating the ratio of the image area to the image forming area on a transfer material, such as a transfer sheet, even though the image area ratio is equal, the consumption amount of toner varies among various sizes of transfer sheets, such as, for example, A3, A4, B4, and B5 sizes. However, with the above-described calculation of the ratio of the image area to the image forming area of the image carrier 10 by the image area ratio calculating device 64, the amount of toner (i.e., the amount of lubricant) applied to the surface of the image carrier 10 may be accurately obtained irrespective of image forming conditions in which toner images are formed on various sizes of transfer sheets, and toner images are continuously formed on a relatively large number of transfer sheets or intermittently formed on the transfer sheets one by one. Therefore, the amount of toner consumption can be accurately obtained, and the abrasion condition of the image carrier 10 may be forecasted based on the amount of toner consumption obtained.

In an image forming apparatus that forms binary images, the amount of toner consumed is determined by calculating the image area while counting the number of image writing pixels. However, in an image forming apparatus that forms multilevel images, the amount of toner consumed is not accurately determined by only counting the number of image writing pixels. In this case, the amount of toner consumed is accurately determined by counting the number of image writing pixels and considering the amount of exposure. Specifically, as the amount of exposure is greater, the count value is increased.

Figure 8:
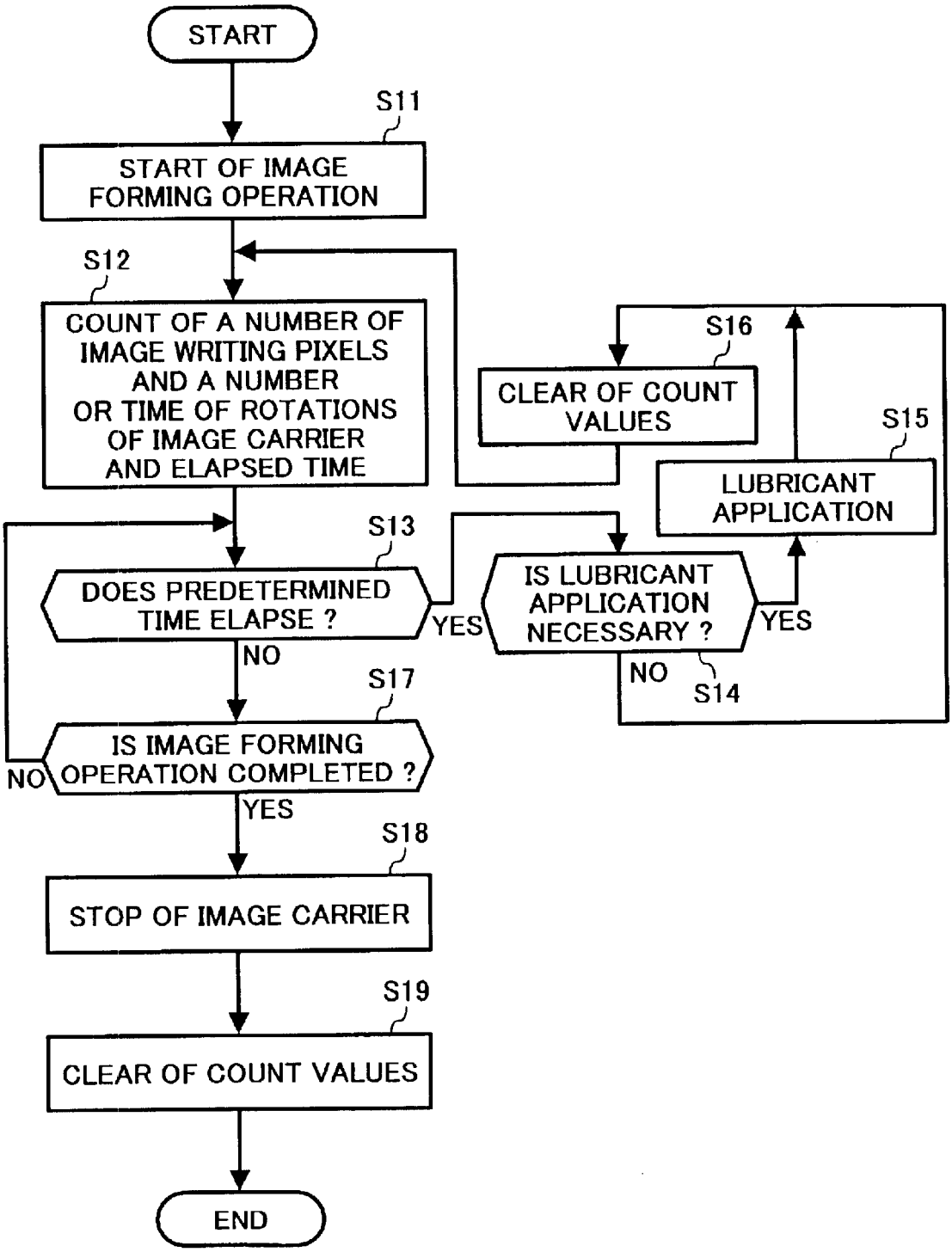
FIG. 8 is a flowchart illustrating main steps of a lubricant application control operation for a laser printer according to another embodiment of the present invention.

FIG. 8 is a flowchart illustrating the main steps of a lubricant application control operation of the laser printer according to another embodiment of the present invention. In step S11, after the controller board 32 receives image data from the personal computer 33, an electrophotographic image forming process including charging, image writing, developing, transferring, and cleaning steps is started. Subsequently, in step S12, the image writing pixel number counting device 60 starts counting the number of image writing pixels, and the rotation number/time of image carrier counting device 62 starts counting the number or time of rotations of the image carrier 10.

Next, the main control board 30 judges (in step S13) if a predetermined time has elapsed after the image forming operation was started. In this embodiment, for example, the above predetermined time corresponds to a period of time from the start of rotation of the image carrier 10 to the completion of the developing process for the electrostatic latent image formed for a predetermined numbered page of a transfer material. If the answer is YES in step S13, the main control board 30 judges if a lubricant application is needed or not based on the lubricant application conditions in step S14. If the answer is YES in step S14, after an electrostatic latent image formed for a preceding transfer material is developed by the developing device 12, the main control board 30 controls the lubricant application executing device 65 to execute the application of the lubricant to the image carrier 10 by actuating the developing device 12 to apply the developer to a discharged area of the surface of the image carrier 10 between the developed electrostatic latent image formed for a preceding transfer material and an electrostatic latent image formed for a succeeding transfer material on the surface of the image carrier 10 in step S15. After the lubricant application operation in step S15, the main control board 30 clears the data of count values in step S16, and the lubricant application control operation returns to reexecute step S12. If the answer is NO in step S14, the lubricant application control operation proceeds to step S16.

If the answer is NO in step S13, the main control board 30 judges if an image forming operation is completed or not in step S17. If the answer is NO in step S17, the lubricant application control operation returns to reexecute step S13. If the answer is YES in step S17, the main control board 30 controls the image carrier/developing device driving motor 37 to stop driving the image carrier 10, and thereby the image carrier 10 stops rotating in step S18. Subsequently, the main control board 30 clears the data of count values in step S19. In the lubricant application control operation of FIG. 8, the period of the steps through S11 to S18 corresponds to one job of an image forming operation from a start of rotation of the image carrier 10 to a stop of the image carrier 10.

In the above-described lubricant application control operation illustrated in FIG. 8, the lubricant application executing device 65 executes the application of the lubricant to the image carrier 10 by actuating the developing device 12 to apply the developer to a discharged area of the surface of the image carrier 10 between a developed electrostatic latent image formed for a preceding transfer material and an electrostatic latent image formed for a succeeding transfer material on the surface of the image carrier 10.

Having generally described this invention, further understanding may be obtained by reference to certain specific non-limiting examples provided herein for illustration purposes only.

EXAMPLE 1

In Example 1, an undercoat layer coating liquid, a charge generation layer coating liquid, a charge transport layer coating liquid, and a protective layer coating liquid were coated and dried on an aluminium substrate (i.e., the electroconductive substrate 50) having a diameter of 30 mm in the order mentioned to prepare the image carrier 10 having an under-coat layer 3.5 μm thick, a charge generation layer 0.15 μm thick, a charge transport layer 20 μm thick, and a protective layer 5 μm thick.

A spray coating method was used for coating the protective layer, and a dip coating method was used for coating the other layers. 25% by weight of alumina having an average particle size of 0.3 μm was added to the protective layer.

0.15% by weight of a zinc stearate powder was added into the toner of the two-component developer used in the developing device 12. The image writing light (L) was that of a laser beam having a wavelength of 655 nm, and AC (2 kHz, 1.8 kVpp) and DC (−750V) were applied to the charging device 11. The process speed was set to 125 mm/sec. In the electrophotographic process thus set, the durability of the image carrier 10 was evaluated.

In Example 1, when the average image area ratio in one job was 2% or less, the lubricant application operation was set to be performed. Specifically, the developing sleeve 26*a* was rotated at 100 millisecond during the discharging operation in the image forming operation, and the developing bias was applied to the developing roller 26. Further, in Example 1, five transfer sheets were printed per one job, and an evaluation of the quality of the produced image was performed after 60,000 total prints were produced.

When the average image area ratio in one job was 5%, the abrasion loss of the image carrier 10 was about 1.6 μm, and about 11,000 prints were produced per one toner bottle. When the average image area ratio in one job was 1.5%, the abrasion loss of the image carrier 10 was about 1.8 μm, and about 28,000 prints were produced per one toner bottle. The toner bottle contains toner of 275 g. The quality of the produced image was good, irrespective of the average image area ratio.

COMPARATIVE EXAMPLE 1

In Comparative Example 1, the procedure for preparation and evaluation of the image carrier was performed in a manner similar to Example 1, except that a lubricant application operation was not performed irrespective of the image area ratio. Like Example 1, an evaluation of the quality of the produced image was performed after 60,000 total prints were produced.

As a result, when the average image area ratio in one job was 5%, the abrasion loss of the image carrier 10 was about 1.8 μm, and about 12,000 prints were produced per one toner bottle. When the average image area ratio in one job was 1.5%, even though about 30,000 prints were produced per one toner bottle, the abrasion loss of the image carrier 10 was about 4.6 μm, and a part of the protective layer 52 was removed due to the abrasion. In addition, the produced image had black stripe-shaped stains.

COMPARATIVE EXAMPLE 2

In Comparative Example 2, the procedure for preparation and evaluation of the image carrier was performed in a manner similar to Example 1, except that a lubricant application operation was not performed irrespective of the image area ratio. Like Example 1, an evaluation of the quality of the produced image was performed after 60,000 total prints were produced. When the average image area ratio in one job was 1.5%, the abrasion loss of the image carrier 10 was about 1.5 μm, and about 27,000 prints were produced per one toner bottle. The quality of the produced image was good. When the average image area ratio in one job was 5%, the abrasion loss of the image carrier 10 was about 0.8 μm and the quality of the produced image was good. However, only about 7000 prints were produced per one toner bottle.

EXAMPLE 2

In Example 1, conditions for the lubricant application operation performed during the discharging operation were determined according to the image area ratio obtained in a preceding image forming operation. In this case, lubricant application conditions were determined based on the image area ratio obtained from only one immediately preceding image forming operation. Therefore, if the image area ratio is once obtained in an image forming operation for an original document having a small image area, the lubricant application operation is performed even if an image forming operation for an original document having a large image area is repeatedly performed thereafter. Thus, it is preferable that the image area ratio should not be obtained based on only one immediately preceding image forming operation, but should be obtained based on several image forming operations while averaging the values. The toner consumption can be reduced to a minimum by determining the lubricant application conditions based on the average image area ratio.

When an average image area ratio is obtained based on five immediately preceding image forming operations, for example, data of a number or time of rotations of the image carrier 10 and a number of image writing pixels is stored in five areas of the non-volatile RAM in the main control board 30.

The total image forming area of the image carrier 10 in five image forming operations is obtained by the following calculation:

$$K \times L,$$

in which (K) is a total running distance of the image carrier 10 for five rotations, and (L) is an image forming width of the image carrier 10 in an axial direction of the image carrier 10.

Further, the total area of electrostatic latent images on the image carrier 10 to be developed with toner by the developing device 12 is obtained by the following calculation:

$$M \times N,$$

in which (M) is a total number of image writing pixels for five rotations of the image carrier 10, and (N) is an area per one image writing pixel.

The average image area ratio is obtained from the calculated total image forming area of the image carrier 10 and total area of electrostatic latent images on the image carrier 10 by the following calculation:

$$O/P,$$

in which (O) is the above-described total area of electrostatic latent images on the image carrier 10, and (P) is the above-described total image forming area of the image carrier 10. A method of determining lubricant application conditions based on the average image area ratio and a lubricant application operation are similar to Example 1.

EXAMPLE 3

The application of lubricant is very effective during a discharging operation in an image forming apparatus in which several prints (less than tens of prints) are formed in one image forming operation. However, in an image forming apparatus in which a large number of prints (e.g., tens of prints at least) are formed in one image forming operation, a sufficient effect can not be obtained when the lubricant is applied to the image carrier 10 during a discharging operation before the stop of the image carrier 10, because the frequency of lubricant application is low relative to the number of prints.

Accordingly, in such an image forming apparatus in which a large number of prints are formed in one image forming operation, it is more effective that the lubricant application operation is performed during an image forming operation (e.g., after the developing process). In this case, it is not necessary to stop the image carrier 10 even when the lubricant application operation is performed during the image forming operation. The toner can be adhered to a non-image area on the image carrier 10 provided between a preceding transfer sheet and a succeeding transfer sheet while the image carrier 10 continuously rotates. In this condition, an interval between transfer sheets is set to be longer than usual.

As a method of adhering toner to the image carrier 10 in a lubricant application operation, at least one of a charging bias and a developing bias is changed (or both charging bias and developing bias can be changed). Alternatively, by attenuating the surface potential of the image carrier 10 with the image writing device 16, toner can be adhered to the image carrier 10. For example, a band-shaped electrostatic latent image can be formed on the image carrier 10 in the axial direction of the image carrier 10 to be developed with toner for the purpose of applying a lubricant to the image carrier 10. The above-described methods of adhering toner to the image carrier 10 can be applied to the lubricant application control operations described referring to FIGS. 6 and 8.

An amount of lubricant to be applied to the image carrier 10 can be adjusted by controlling respective amounts of charging and developing bias, and an amount of exposure light from the image writing device 16. As an example of a lubricant application control operation, when an image forming operation is still performed after a predetermined time (e.g., 100 seconds) elapses from a start of image forming operation, the main control board 30 judges if an image area ratio exceeds a predetermined value. If the image area ratio equals to the predetermined value or less, a lubricant application operation is performed while intermitting an image forming operation. The method of calculating the image area ratio and the method of determining lubricant application conditions are similar to Examples 1 and 2. The above-described lubricant application operation can occur in combination with another lubricant application operation performed during a discharging operation before the stop of the image carrier 10.

In the above-described laser printer, the main control board 30 controls the lubricant application executing device 65 to execute an application of the lubricant to the image carrier 10 based on the image area ratio calculated by the image area ratio calculating device 64. By performing the above-described lubricant application control operations, the lubricant can be adequately and efficiently applied to the surface of the image carrier 10. Therefore, the mechanical durability of the image carrier 10 can be improved and the surface energy of the image carrier 10 can be reduced. As a result, the transfer efficiency of the toner image formed on the image carrier 10 can increase, thereby preventing an inferior image, such as a partial omission of a transferred image.

The present invention has been described with respect to the embodiments as illustrated in figures. However, the present invention is not limited to these embodiments and can be practiced otherwise.

The present invention has been described with respect to a laser printer as an example of an image forming apparatus. However, the present invention can be applied to other image forming apparatuses such as a copying machine, a facsimile machine or a multifunctional image forming apparatus.

Numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus, comprising:

an image carrier configured to rotate and carry an image on a surface of the image carrier;

a latent image forming device configured to form an electrostatic latent image on the image carrier;

a developing device configured to develop the electrostatic latent image with a developer including a lubricant;

a transfer device configured to transfer the image to a transfer material; and a control device including a lubricant application executing device to at least control the lubricant application executing device to execute an application of the lubricant to the image carrier by actuating the developing device to apply the developer to the surface of the image carrier during one job of an image forming operation from a start of rotation of the image carrier to a stop of the image carrier, wherein the control device further includes an image area calculating device configured to calculate an area of an image formed on the surface of the image carrier, and wherein the lubricant application executing device executes the application of the lubricant to the surface of the image carrier based at least in part on the calculated area of the image provided by the image area calculating device.

2. The image forming apparatus according to claim 1, further comprising a cleaning device including a cleaning blade to remove a residual developer remaining on the image carrier after the image is transferred to the transfer material.

3. The image forming apparatus according to claim 1, wherein the image carrier is formed from an organic photoreceptor, and wherein a surface of the organic photoreceptor comprises a protective layer including a filler.

4. The image forming apparatus according to claim 1, wherein the lubricant application executing device executes the application of the lubricant to the image carrier in a period in the one job after the electrostatic latent image formed for a last transfer material is developed by the developing device and before the stop of the image carrier.

5. The image forming apparatus according to claim 4, further comprising a discharging device configured to discharge the surface of the image carrier, wherein the lubricant application executing device executes the application of the lubricant to the image carrier by actuating the developing device to apply the developer to the discharged surface of the image carrier.

6. The image forming apparatus according to claim 1, wherein the lubricant application executing device executes the application of the lubricant to the image carrier in a period in the one job after the electrostatic latent image formed for a preceding transfer material is developed by the developing device and before the electrostatic latent image for a succeeding transfer material is developed by the developing device.

7. The image forming apparatus according to claim 6, further comprising a discharging device configured to discharge the surface of the image carrier, wherein the lubricant application executing device executes the application of the lubricant to the image carrier by actuating the developing device to apply the developer to a discharged area of the surface of the image carrier between the developed electrostatic latent image formed for the preceding transfer material and the electrostatic latent image formed for the succeeding transfer material on the surface of the image carrier.

8. The image forming apparatus according to claim 1, wherein the control device further includes an image writing pixel counting device configured to count a number of image writing pixels of the image formed on the surface of the image carrier, and wherein the writing pixel counting device provides the number of image writing pixels counted to the image area calculating device as an input used to calculate the area of the image formed on the surface of the image carrier.

9. The image forming apparatus according to claim 8, wherein the control device further includes an image area ratio calculating device configured to calculate a ratio of the image area calculated by the image area calculating device relative to a running distance of the image carrier, and wherein the lubricant application executing device executes the application of the lubricant to the surface of the image carrier based on the ratio of the image area calculated by the image area ratio calculating device.

10. The image forming apparatus according to claim 9, wherein the control device controls the lubricant application executing device to adjust an amount of the lubricant applied to the surface of the image carrier according to the ratio of the image area calculated by the image area ratio calculating device.

11. An image forming apparatus, comprising:

image carrying means for rotating and carrying an image on a surface of the image carrying means;

latent image forming means for forming an electrostatic latent image on the image carrying means;

developing means for developing the electrostatic latent image with a developer including a lubricant;

transferring means for transferring the image to a transfer material; and control means including lubricant application executing means for executing an application of the lubricant to the image carrying means, the control means at least controlling the lubricant application executing means to execute an application of the lubricant to the image carrier by actuating the developing means to apply the developer to the surface of the image carrying means during one job of an image forming operation from a start of rotation of the image carrying means to a stop of the image carrying means, wherein the control means further includes image area calculating means for calculating an area of an image formed on the surface of the image carrying means, and wherein the lubricant application executing means executes the application of the lubricant to the surface of the image carrying means based at least in part on the calculated area of the image provided by the image area calculating means.

12. The image forming apparatus according to claim 11, further comprising removing means for removing a residual developer remaining on the image carrying means alter the image is transferred to the transfer material.

13. The image forming apparatus according to claim 11, wherein the image carrying means is formed from an organic photoreceptor, and wherein a surface of the organic photoreceptor comprises a protective layer including a filler.

14. The image forming apparatus according to claim 11, wherein the lubricant application executing means executes the application of the lubricant to the image carrying means in a period in the one job after the electrostatic latent image formed for a last transfer material is developed by the developing means and before the stop of the image carrying means.

15. The image forming apparatus according to claim 14, further comprising discharging means for discharging the surface of the image carrying means, wherein the lubricant application executing means executes the application of the lubricant to the image carrying means by actuating the developing means to apply the developer to the discharged surface of the image carrying means.

16. The image forming apparatus according to claim 11, wherein the lubricant application executing means executes the application of the lubricant to the image carrying means in a period in the one job after the electrostatic latent image formed for a preceding transfer material is developed by the developing means and before the electrostatic latent image for a succeeding transfer material is developed by the developing means.

17. The image forming apparatus according to claim 16, further comprising discharging means for discharging the surface of the image carrying means, wherein the lubricant application executing means executes the application of the lubricant to the image carrying means by actuating the developing means to apply the developer to a discharged area of the surface of the image carrying means between the developed electrostatic latent image formed for the preceding transfer material and the electrostatic latent image formed for the succeeding transfer material on the surface of the image carrying means.

18. The image forming apparatus according to claim 11, wherein the control means further includes an image writing pixel counting means for counting a number of image writing pixels of the image formed on the surface of the image carrying means, and wherein the writing pixel counting means provides the number of image writing pixels counted to the image area calculating means as an input used to calculate the image area formed on the surface of the image carrier.

19. The image forming apparatus according to claim 18, wherein the control means further includes image area ratio calculating means for calculating a ratio of the image area calculated by the image area calculating means relative to a running distance of the image carrying means, and wherein the lubricant application executing means executes the application of the lubricant to the surface of the image carrying means based on the ratio of the image area calculated by the image area ratio calculating means.

20. The image forming apparatus according to claim 19, wherein the control means controls the lubricant application executing means to adjust an amount of the lubricant applied to the surface of the image carrying means according to the ratio of the image area calculated by the image area ratio calculating means.

21. A method for forming an image, comprising the steps of:

rotating an image carrier;

forming an electrostatic latent image on the rotating image carrier;

developing the electrostatic latent image on the rotating image carrier with a developer including a lubricant;

transferring the developed image to a transfer material; and at least controlling an application of the lubricant to the image carrier by controlling an application of the developer including the lubricant to the image carrier during one job of an image forming operation from a start of rotation of the image carrier to a stopping of the rotation of the image carrier based at least in part on calculating an area of image formation on the image carrier.

* * * * *